US008217859B2

(12) United States Patent
An et al.

(10) Patent No.: US 8,217,859 B2
(45) Date of Patent: Jul. 10, 2012

(54) PLASMA DISPLAY DEVICE AND DRIVING METHOD THEREOF WITH AN INITIAL DRIVING WAVEFORM

(75) Inventors: Jung-Soo An, Suwon-si (KR); Suk-Ki Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 962 days.

(21) Appl. No.: 12/222,276

(22) Filed: Aug. 6, 2008

(65) Prior Publication Data

US 2009/0040144 A1 Feb. 12, 2009

(30) Foreign Application Priority Data

Aug. 8, 2007 (KR) ..... 10-2007-0079581

(51) Int. Cl.
*G09G 3/28* (2006.01)

(52) U.S. Cl. ..... 345/67; 345/68

(58) Field of Classification Search ..... 345/60–72
See application file for complete search history.

(56) References Cited

U.S. PATENT DOCUMENTS 6,853,145 B2 * 2/2005 Kang et al. ..... 315/169.1
2004/0021653 A1 * 2/2004 Kim et al. ..... 345/204
2004/0027316 A1 * 2/2004 Kang et al. ..... 345/60
2006/0139247 A1 * 6/2006 Chung et al. ..... 345/68
2007/0152915 A1 * 7/2007 Lee et al. ..... 345/67
2008/0062165 A1 * 3/2008 Park et al. ..... 345/214
2008/0191973 A1 * 8/2008 Rhee ..... 345/67
2008/0252564 A1 * 10/2008 Choi et al. ..... 345/67
2009/0002277 A1 * 1/2009 Park et al. ..... 345/60
2009/0040144 A1 * 2/2009 An et al. ..... 345/60

FOREIGN PATENT DOCUMENTS

KR 10-2005-0113830 A 12/2005
KR 10-2006-0072813 A 6/2006
KR 10-2007-0053485 A 7/2007
KR 10-2007-0074420 A 7/2007

* cited by examiner

*Primary Examiner* — Chanh Nguyen
*Assistant Examiner* — Navin Lingaraju
(74) *Attorney, Agent, or Firm* — Lee & Morse, P.C.

(57) ABSTRACT

A method of driving a plasma display device having a first electrode and a second electrode adjacent to one another in a discharge cell, including applying a first waveform at least once to the first electrode, the first waveform including a gradual increase from a first voltage to a second voltage followed by a gradual decrease from a third voltage to a fourth voltage, and applying a second waveform at least once to the first electrode after the first waveform is applied to the first electrode, the second waveform including a gradual increase from a fifth voltage to a sixth voltage followed by a gradual decrease from a seventh voltage to an eighth voltage. The first and second waveforms may be applied to the first electrode after turning on the plasma display device and before a display operation is performed.

14 Claims, 5 Drawing Sheets

PLASMA DISPLAY DEVICE AND DRIVING METHOD THEREOF WITH AN INITIAL DRIVING WAVEFORM

BACKGROUND OF THE INVENTION

1. Field of the Invention

Embodiments relate to a plasma display device and a driving method thereof, in which an initial driving operation is performed after the plasma display device is turned on.

2. Description of the Related Art

A plasma display device is a display using a plasma display panel (PDP) that uses plasma generated by gas discharge to display characters, images, etc. In the PDP, a plurality of discharge cells may be arranged with corresponding pluralities of electrodes, and images may be displayed by performing a display operation in which the electrodes are driven according to a plurality of subfields for each frame.

After the display device is turned on, and before the display operation is performed, an initial driving waveform may be applied to the discharge cells to form wall charges therein. However, the initial driving waveform may generate a strong discharge due to lack of priming particles in the discharge cells. The strong discharge may cause a glittering phenomenon to partially appear in the PDP, and the wall charges may not be properly formed in the cells.

The above information disclosed in this Background section is only for enhancement of understanding of the related art, and is not provided as prior art.

SUMMARY OF THE INVENTION

Embodiments are therefore directed to a plasma display device and a driving method thereof, which substantially overcome one or more of the problems due to the limitations and disadvantages of the related art.

It is therefore a feature of an embodiment to provide a plasma display device and a driving method thereof, in which an initial driving operation includes first and second waveforms for suppressing the generation of a strong discharge.

At least one of the above and other features and advantages may be realized by providing a method of driving a plasma display device having a first electrode and a second electrode adjacent to one another in a discharge cell, the method including applying a first waveform at least once to the first electrode, the first waveform including a gradual increase from a first voltage to a second voltage followed by a gradual decrease from a third voltage to a fourth voltage, and applying a second waveform at least once to the first electrode after the first waveform is applied to the first electrode, the second waveform including a gradual increase from a fifth voltage to a sixth voltage followed by a gradual decrease from a seventh voltage to an eighth voltage. The fifth voltage may be greater than the first voltage, the sixth voltage may be greater than the second voltage, during the gradual increases in the voltage of the first electrode, the second electrode may be maintained at a reference voltage, during the gradual decreases in the voltage of the first electrode, the second electrode may be maintained at a voltage greater than the reference voltage, and the first and second waveforms may be applied to the first electrode after turning on the plasma display device and before a display operation is performed.

A period of the first waveform during which the voltage of the first electrode is gradually increased from the first voltage to the second voltage may be longer than a period of the second waveform during which the voltage of the first electrode is gradually increased from the fifth voltage to the sixth voltage. A rate of increase in the voltage of the first waveform from the first voltage to the second voltage may be less than a rate of increase in the voltage of the second waveform from the fifth voltage to the sixth voltage. During the gradual increase in the voltage of the first electrode to the second voltage, the second electrode may be allowed to float after being maintained at the reference voltage and before the voltage of the first electrode reaches the second voltage.

The method may further include applying a reset waveform to the first and second electrodes during a reset period that is after the application of the first and second waveforms, the reset waveform initializing the discharge cell before an address period thereof. Applying the reset waveform may include applying the second waveform to the first electrode, during gradual increases in the voltage of the first electrode in the reset waveform, the second electrode may be maintained at the reference voltage, and during gradual decreases in the voltage of the first electrode in the reset waveform, the second electrode may be maintained at a voltage greater than the reference voltage. A voltage difference between the first and second electrodes at the end of the gradual increase in the voltage of the first electrode during application of the first waveform may be less than a voltage difference between the first and second electrodes at the end of the gradual increase in the voltage of the first electrode during application of the second waveform.

At least one of the above and other features and advantages may also be realized by providing a plasma display device, including a plasma display panel having a plurality of discharge cells corresponding to a plurality of first electrodes and a plurality of second electrodes, the plurality of first and second electrodes performing a display operation, and a driving circuit configured to apply a driving voltage to the plurality of first electrodes and the plurality of second electrodes, the driving circuit being configured to apply a first waveform at least once to the first electrode, the first waveform including a gradual increase from a first voltage to a second voltage followed by a gradual decrease from a third voltage to a fourth voltage, and apply a second waveform at least once to the first electrode after the first waveform is applied to the first electrode, the second waveform including a gradual increase from a fifth voltage to a sixth voltage followed by a gradual decrease from a seventh voltage to an eighth voltage. The fifth voltage may be greater than the first voltage, the sixth voltage may be greater than the second voltage, during the gradual increases in the voltage of the first electrode, the second electrode may be maintained at a reference voltage, during the gradual decreases in the voltage of the first electrode, the second electrode may be maintained at a voltage greater than the reference voltage, and the first and second waveforms may be applied to the first electrode after turning on the plasma display device and before a display operation is performed.

The driving circuit may set a period of the first waveform during which the voltage of the first electrode is gradually increased from the first voltage to the second voltage to be longer than a period of the second waveform during which the voltage of the first electrode is gradually increased from the fifth voltage to the sixth voltage. The driving circuit may set a rate of increase in the voltage of the first waveform from the first voltage to the second voltage to be less than a rate of increase in the voltage of the second waveform from the fifth voltage to the sixth voltage. During the gradual increase in the voltage of the first electrode to the second voltage, the driving circuit may allow the second electrode to float after maintaining the second electrode at the reference voltage and before the voltage of the first electrode reaches the second voltage.

The plasma display device may further include a controller configured to drive one frame by dividing the frame into a plurality of subfields including at least one reset period. The driving circuit may apply a reset waveform to the first and second electrodes during a reset period that is after the application of the first and second waveforms, the reset waveform initializing the discharge cell before an address period thereof. Applying the reset waveform may include applying the second waveform to the first electrode, during gradual increases in the voltage of the first electrode in the reset waveform, the driving circuit may maintain the second electrode at the reference voltage, and during gradual decreases in the voltage of the first electrode in the reset waveform, the driving circuit may maintain the second electrode at a voltage greater than the reference voltage. A voltage difference between the first and second electrodes at the end of the gradual increase in the voltage of the first electrode during application of the first waveform may be less than a voltage difference between the first and second electrodes at the end of the gradual increase in the voltage of the first electrode during application of the second waveform.

At least one of the above and other features and advantages may also be realized by providing a method of driving a plasma display device having a first electrode and a second electrode adjacent to one another in a discharge cell, the method including gradually increasing an initialization voltage difference from a first amount to a second amount, the initialization voltage difference being a voltage difference between the second electrodes and the first electrodes, gradually decreasing the initialization voltage difference from a third amount to a fourth amount, gradually increasing the initialization voltage difference from a fifth amount to a sixth amount, and gradually decreasing the initialization voltage difference from a seventh amount to an eighth amount. The fifth amount may be greater than the first amount, the sixth amount may be greater than the second amount, and the first through eighth amounts of the initialization voltage difference may occur sequentially after turning on the plasma display and before a display operation is performed.

A period during which the initialization voltage difference is gradually increased from the first amount to the second amount may be longer than a period during which the initialization voltage difference is gradually increased from the fifth amount to the sixth amount. Gradually increasing the initialization voltage difference from the first amount to the second amount may include increasing the voltage of the first electrode from a first voltage to a second voltage while maintaining the voltage of the second electrode at a reference voltage, and gradually increasing the initialization voltage difference from the fifth amount to the sixth amount may include increasing the voltage of the first electrode from a fifth voltage to a sixth voltage while maintaining the voltage of the second electrode at the reference voltage, the fifth voltage may be greater than the first voltage, and the sixth voltage may be greater than the second voltage.

During the gradual increase in the initialization voltage difference to the second amount, the second electrode may be allowed to float after being maintained at the reference voltage and before the initialization voltage difference reaches the second amount. The initialization voltage difference may be increased to the sixth amount after repeating the increase of the initialization voltage difference to the second amount and the decrease the initialization voltage difference to the fourth amount at least one time, and after the initialization voltage difference is decreased to the eighth amount, the increase of the initialization voltage difference to the sixth amount and the decrease of the initialization voltage difference to the eighth amount is repeated at least one time. The method may further include applying a reset waveform to the first and second electrodes during a reset period that is after the at least one repetition of the increase of the initialization voltage difference to the sixth amount and the decrease of the initialization voltage difference to the eighth amount.

At least one of the above and other features and advantages may also be realized by providing an article of manufacture having encoded therein machine-accessible instructions that, when executed by a machine, cause the machine to gradually increase an initialization voltage difference from a first amount to a second amount, the initialization voltage difference being a voltage difference between the second electrodes and the first electrodes, gradually decrease the initialization voltage difference from a third amount to a fourth amount, gradually increase the initialization voltage difference from a fifth amount to a sixth amount, and gradually decrease the initialization voltage difference from a seventh amount to an eighth amount. The fifth amount may be greater than the first amount, the sixth amount may be greater than the second amount, and the first through eighth amounts of the initialization voltage difference may occur sequentially after turning on the plasma display and before a display operation is performed.

BRIEF DESCRIPTION OF THE DRAWINGS

The above and other features and advantages will become more apparent to those of ordinary skill in the art by describing in detail example embodiments with reference to the attached drawings, in which.

DETAILED DESCRIPTION OF THE INVENTION

Figure 1:
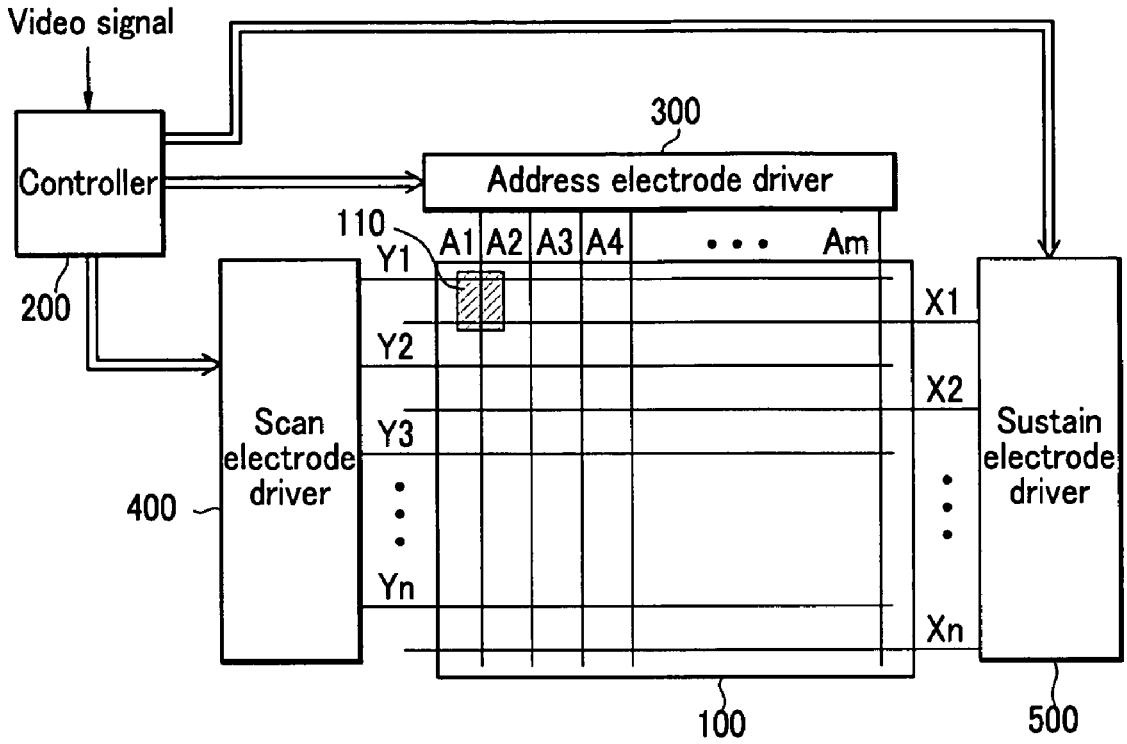
FIG. 1 illustrates a plasma display device.

Korean Patent Application No. 10-2007-0079581, filed on Aug. 8, 2007, in the Korean Intellectual Property Office, and entitled: "Plasma Display Device and Driving Method Thereof," is incorporated by reference herein in its entirety.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions may be exaggerated for clarity of illustration. Like reference numerals refer to like elements throughout.

"Wall charges" described herein mean charges formed and accumulated on a wall, e.g., a dielectric layer, close to an electrode of a discharge cell. A wall charge may be described as being "formed on" or "accumulated on" the electrode, although the wall charges may not actually touch the electrode. Further, a "wall voltage" means a potential difference formed on the wall of the discharge cell by the wall charge.

Where an element is described as being coupled to a second element, the element may be directly coupled to the second element, or may be indirectly coupled to the second element via one or more other elements. Further, where an element is described as being coupled to a second element, it will be understood that the elements may be electrically coupled, e.g., in the case of transistors, capacitors, power sources, nodes, etc.

As used herein, the terms "a" and "an" are open terms that may be used in conjunction with singular items or with plural items. For example, the term "a driving circuit" may represent a single driving circuit or multiple driving circuits.

A plasma display and a driving method thereof according to example embodiments will now be described.

FIG. 1 illustrates a plasma display device.

Referring to FIG. 1, the plasma display device may include a plasma display panel (PDP) 100, a controller 200, an address electrode driver 300, a scan electrode driver 400, and a sustain electrode driver 500.

The PDP 100 may include a plurality of address electrodes A1 to Am extending in a column direction, and a plurality of sustain electrodes X1 to Xn and a plurality of scan electrodes Y1 to Yn extending in a row direction as pairs. Each pair may include one of sustain electrodes X1 to Xn and a respective one of the scan electrodes Y1 to Yn. Discharge cells 110 may be formed where the address electrodes cross the sustain and scan electrodes.

The controller 200 may receive externally-supplied video signals and may output an address electrode driving control signal, a sustain electrode driving control signal, and a scan electrode driving control signal. The controller 200 may divide one frame into a plurality of subfields, each subfield having a weight, according to the input video signals. Each subfield may include an address period for selecting turn-on/turn-off discharge cells 110, i.e., for selecting discharge cells 110 that are to be turned on or turned off, and a sustain period for performing a display operation by sustain-discharging the turned-on discharge cells 110. In addition, at least one of the plurality of subfields may further include a reset period for initializing at least one of the plurality of discharge cells 110.

Before the display operation is performed, and after the plasma display device is turned on, the controller 200 may output driving control signals to control the application of an initial driving waveform to the scan electrodes Y and the sustain electrodes X during an initial period. The initial driving waveform may efficiently form wall charges in the discharge cells 110. In an implementation, driving control signals may be applied to the address electrodes A during the initial period.

The scan electrode driver 400 may apply a driving voltage to the plurality of scan electrodes Y1 to Yn according to the scan electrode driving control signal from the controller 200. The sustain electrode driver 500 may apply a driving voltage to the plurality of sustain electrodes X1 to Xn according to the sustain electrode driving control signal from the controller 200. The address electrode driver 300 may apply a driving voltage to the plurality of address electrodes A1 to Am according to the address electrode driving control signal from the controller 200.

Figure 2:
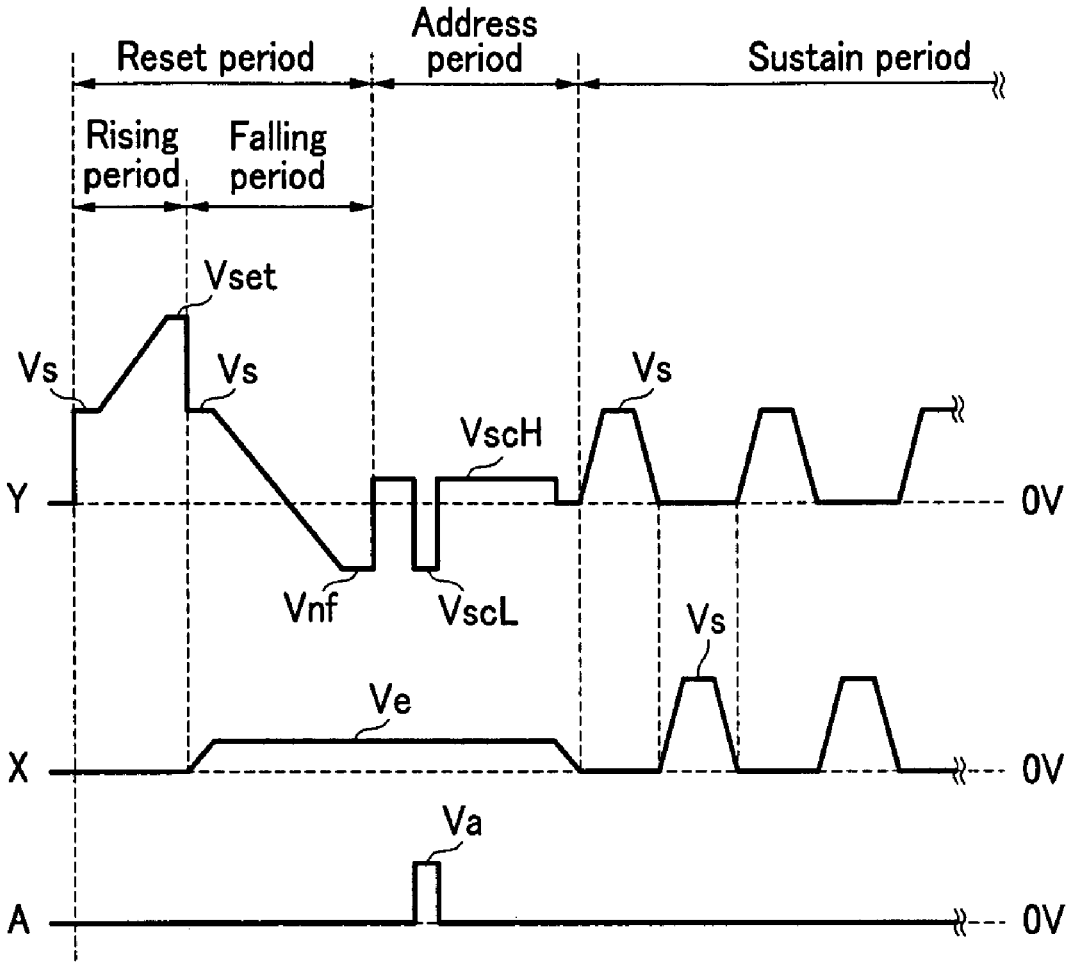
FIG. 2 illustrates driving waveforms of a display period in the plasma display device.

FIG. 2 illustrates driving waveforms of a display period in the plasma display device.

In the following description of the driving waveforms shown in FIG. 2, for better understanding and clarity of description, driving waveforms of only one subfield among a plurality of subfields from one frame are illustrated. Further, driving waveforms applied to a sustain electrode X, a scan electrode Y, and an address electrode A of a single cell are shown.

Referring to FIG. 2, the subframe may include a reset period, an address period, and a sustain period, in sequence. In a rising period of the reset period, a voltage of the sustain electrode X and a voltage of the address electrode A may be maintained at a reference voltage, e.g., 0 V, and a voltage of the scan electrode Y may be gradually increased from a voltage Vs to a voltage Vset. When the voltage of the scan electrode Y is gradually increased, a weak discharge may be generated between the scan electrode Y and the sustain electrode X, and between the scan electrode Y and the address electrode A. Accordingly, negative (−) wall charges may be formed on the scan electrode Y, and positive (+) wall charges may be formed on the sustain and address electrodes X and A.

In a falling period of the reset period, the voltage of the scan electrode Y may be gradually decreased from the voltage Vs to a voltage Vnf while the voltage of the address electrode A and the voltage of the sustain electrode X are respectively maintained at the reference voltage and a voltage Vs. While the voltage of the scan electrode Y is gradually decreased, a weak discharge may be generated between the scan electrode Y and the sustain electrode X, and between the scan electrode Y and the address electrode A. Accordingly, negative (−) wall charges formed on the scan electrode Y, and positive (+) wall charges formed on the sustain electrode X and the address electrode A, may be erased.

A voltage difference (Vnf−Ve) may be set close to a discharge firing voltage between the scan electrode Y and the sustain electrode X. Thus, a wall voltage between the scan electrode Y and the sustain electrode X may become about 0 V. Therefore, a cell that was not addressed with an address discharge during the address period may be prevented from misfiring during the sustain period.

In the address period, a scan pulse having a voltage VscL and an address pulse having a voltage Va may be respectively applied to the scan electrode Y and the address electrode A to select the discharge cell 110 as a turn-on cell, while the voltage Vs may be applied to the sustain electrode X. An address discharge may be generated between the address electrode A, to which the voltage Va is applied, and the sustain electrode X, to which the voltage VscL is applied.

Scan electrodes Y to which the voltage VscL is not applied may receive a voltage VscH that is greater than the voltage VscL, and address electrodes A of unselected discharge cells 110 may be supplied with 0 V. Vs may be greater than 0 V.

In the address period, the scan electrode driver 400 may apply the scan pulse to a scan electrode (Y1 of FIG. 1) of the first row, and at the same time, the address electrode driver 300 may apply the address pulse to an address electrode A that passes through a light emitting discharge cell 110 of the first row. Scan electrodes (Y2 to Yn of FIG. 1) of other rows may be supplied with the voltage VscH. An address discharge may be generated between the scan electrode (Y1 of FIG. 1) of the first row and the address electrode A to which the address pulse is applied. Accordingly, positive (+) wall charges may be formed on the scan electrode Y, and negative (−) wall charges may be formed on the address electrode A and the sustain electrode X.

Subsequently, the address electrode driver 300 may apply the address pulse to an address electrode A that passes through a light emitting cell of the second row while the scan electrode driver 400 applies the scan pulse to the scan electrode (Y2 of FIG. 1) of the second row. Scan electrodes (Y1, and Y3 to Yn of FIG. 1) of other rows may be supplied with the voltage VscH. An address discharge may be generated in a discharge cell 110 corresponding to the address electrode A to which the address pulse is applied and the scan electrode (Y2 of FIG. 1) of the second row. Accordingly, wall charges may be formed in the discharge cell 110. The scan electrode driver 400 may sequentially apply the scan pulse to the scan electrodes of the other rows while the address electrode driver 300 applies the address pulse to the address electrode A that passes through the light emitting cell so as to form wall charges.

In the sustain period, a sustain pulse, which has a high level voltage (Vs voltage in FIG. 2) and a low level voltage (0 V voltage in FIG. 2), may be applied to the scan electrode Y and the sustain electrode X, respectively, in opposite phases. Thus, 0 V may be applied to the sustain electrode X when the voltage Vs is applied to the scan electrode Y, and the voltage Vs may be applied to the sustain electrode X when 0 V is applied to the scan electrode Y. Accordingly, a voltage difference between the respective scan electrodes Y and the sustain electrodes X may alternately be Vs and −Vs, and a sustain discharge may be generated the turned-on discharge cell 110, i.e., an addressed discharge cell 110 that is to emit light, a predetermined number of times. The operation of applying the sustain pulse to the scan electrode Y and the sustain electrode X may be repeated a number of times that corresponds to a weight of the particular subfield of the plurality of subfields.

When a plasma display device that is in a turned-off state is subsequently turned on, an initial driving waveform may be applied to the scan electrode Y, the scan electrode X, and the address electrode A during an initial stage of operation. The initial driving waveform may be applied prior to the display of text, images, etc., using driving waveforms such as those shown in FIG. 2 during normal display operation.

Figure 3:
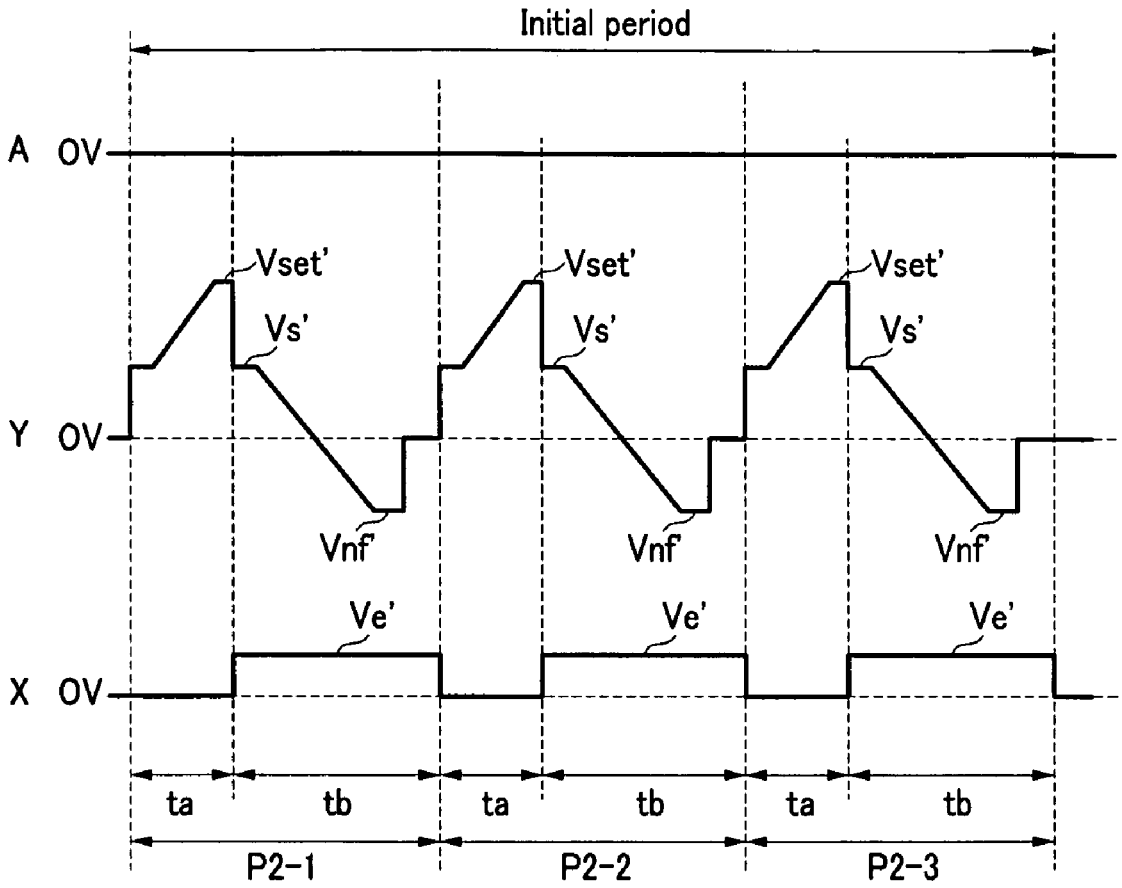
FIG. 3 illustrates an initial driving waveform of the plasma display device, which precedes the driving waveform shown in FIG. 2.

FIG. 3 illustrates an initial driving waveform of the plasma display device, which precedes the driving waveform shown in FIG. 2.

One or more cycles of the initial driving waveform may be performed during the initial period. For example, as shown in FIG. 3, three cycles P2-1, P2-2 and P2-3 of the initial driving waveform may be performed during the initial period. Each cycle of the initial driving waveform may be similar to the reset waveform shown in FIG. 2.

At the beginning of the cycle of the initial driving waveform, during a time ta, a voltage of the scan electrode Y may be gradually increased from a reference voltage, e.g., 0 V, to a voltage Vset'. The voltage of the address electrode A and the voltage of the sustain electrode X may be maintained at the reference voltage of 0 V during the time ta. This may result in a weak discharge being generated between the scan electrode Y and the sustain electrode X, and between the scan electrode Y and the address electrode A, while the voltage of the scan electrode Y is increased. Accordingly, negative (−) wall charges may be formed on the scan electrode Y, and positive (+) wall charges may be formed on the sustain electrode X and the address electrode A. The voltage of the scan electrode Y may then be sharply decreased from the voltage Vset' to a voltage Vs'.

During a subsequent portion of the cycle, during a time tb, the voltage of the scan electrode Y may be gradually decreased from the voltage Vs' to a voltage Vnf'. During the time tb, the voltage of the address electrode A may remain at 0 V, while the voltage of the sustain electrode X may be maintained at a voltage Ve' that is greater than the reference voltage, i.e., greater than 0 V. The voltages Vs', Vset', and Vnf' voltage may correspond to the voltages Vs, Vset, and Vnf voltage of the reset period shown in FIG. 2, respectively. In an implementation, the voltages Vs', Vset', and Vnf' may be equal to the voltages Vs, Vset, and Vnf of the reset period, respectively.

While the voltage of the scan electrode Y is gradually decreased from the voltage Vs' to the voltage Vnf', a weak discharge may be generated between the scan electrode Y and the sustain electrode X, and between the scan electrode Y and the address electrode A. Accordingly, negative (−) wall charges formed on the scan electrode Y, and positive (+) wall charges formed on the sustain electrode X and the address electrode A may be erased.

Wall charges and priming particles may be formed in the discharge cell through application of one or more cycles of the initial driving waveform shown in FIG. 3. However, when the plasma display device is turned on and the voltage of the scan electrode Y is increased to the voltage Vset' without having sufficient priming particles formed in the cell, a strong discharge may be generated between the scan electrode Y and the sustain electrode X due to a high voltage difference between the scan electrode Y and the sustain electrode X. When such a strong discharge is generated, wall charges and priming particles may not be normally formed in the cell.

Hereinafter, operations for suppressing the generation of a strong discharge will be described in detail with reference to FIG. 4 and FIG. 5.

Figure 4:
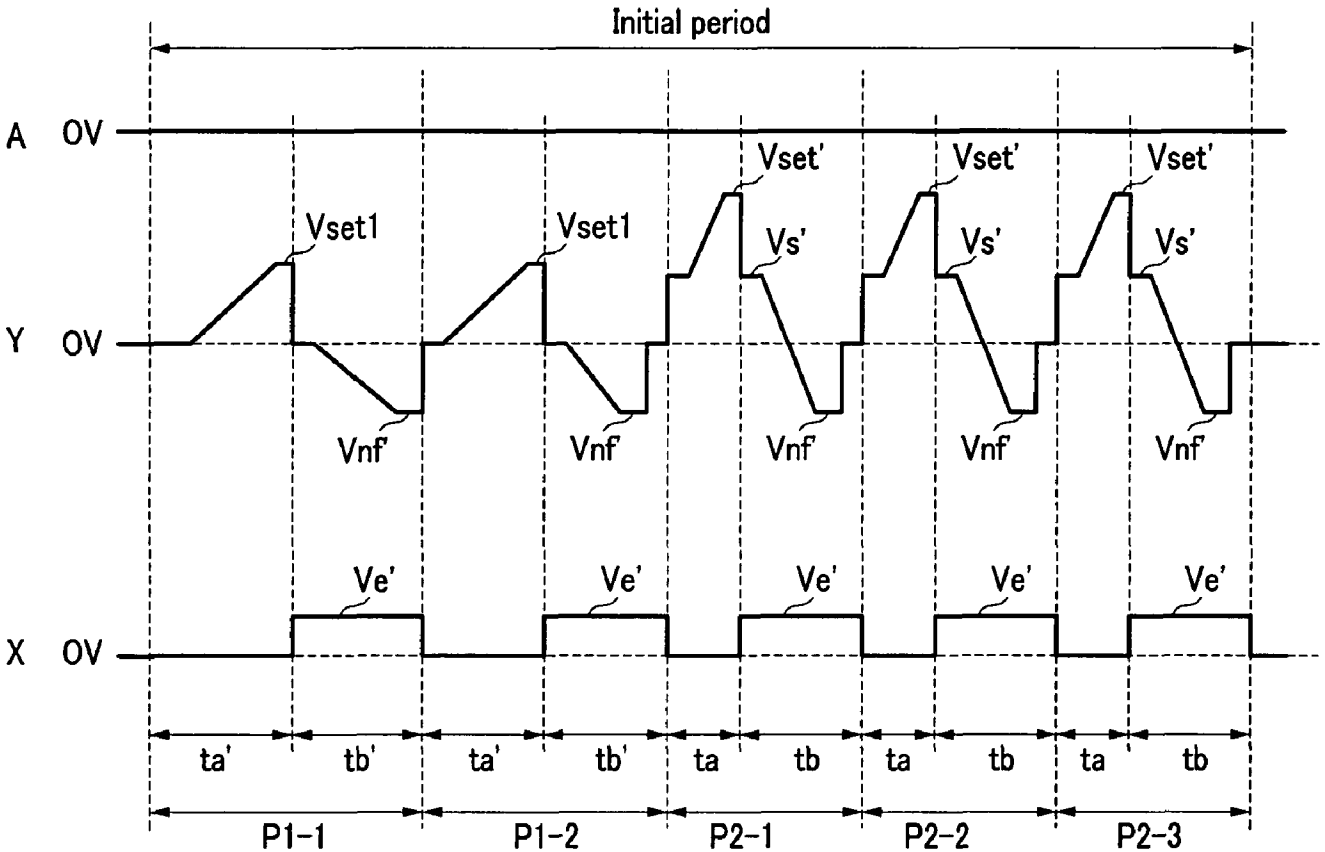
FIG. 4 illustrates an initial driving waveform of the plasma display device according to a first embodiment, which precedes the driving waveform shown in FIG. 2.

FIG. 4 illustrates an initial driving waveform of the plasma display device according to a first embodiment, which precedes the driving waveform shown in FIG. 2.

As shown in FIG. 4, during the initial period, after the plasma display device is turned on and before the application of the driving waveforms, e.g., the before the application of the driving waveforms shown in FIG. 2, first and second waveforms of the initial driving waveform according to the first embodiment may be applied to the electrodes of the discharge cell.

The first waveform may be applied for one or more cycles thereof before applying the second waveform. For example, as shown in FIG. 4, the first waveform may be applied for two cycles, as indicated by the periods P1-1 and P1-2.

Each cycle of the first waveform may include a time ta' and a time tb'. The time ta' may be longer than the time ta in the second waveform. The time tb' may have the same duration as the time tb in the second waveform.

Each cycle of the first waveform may include increasing the voltage of the scan electrode Y from 0 V to a voltage Vset1. Subsequently, the voltage of the scan electrode Y may be sharply decreased from the voltage Vset 1 to 0 V, after which the voltage of the scan electrode Y may be gradually decreased to the voltage Vnf'. The operation of decreasing the voltage of the scan electrode Y to the voltage Vnf' after increasing the voltage of the scan electrode Y to the voltage Vset1 may be repeated at least once. As illustrated in FIG. 4, the operation is repeated once, such that a total of two cycles of the first waveform are applied, as indicated by the periods P1-1 and P1-2.

After application of the first waveform, the second waveform may be applied for one or more cycles. The second waveform may be the waveform illustrated in FIG. 3. As described in detail above in connection with FIG. 3, each cycle of the second waveform may include gradually increasing the voltage of the scan electrode Y from 0 V to the voltage Vset', followed by gradually decreasing the voltage of the scan electrode Y from 0 V to the voltage Vnf. The voltage Vset' of the second waveform may be greater than the voltage Vset1 of the first waveform.

In the first waveform, the time ta' of the period P1, during which the voltage of the scan electrode Y is increased from 0

V to the voltage Vset1, may be longer than the time ta of the period P2 in the second waveform, during which the voltage of the scan electrode Y is increased from the voltage Vs' to the voltage Vset'. Accordingly, the rate of voltage change of the scan electrode Y, i.e., the slope with which the voltage of the scan electrode Y is increased, may be less between 0 V and the voltage Vset1 during the time ta' in the first waveform than it is during the time ta between the voltage Vs' and the voltage Vset' in the second waveform.

In an example implementation, the length of periods P1-1 and P1-2 may each be 42.4 milliseconds (ms), and the length of periods P2-1, P2-2 and P2-3 may each be 38.8 ms. Furthermore, the length of the initial period may be between approximately 200 ms and 250 ms. It will be appreciated that the length of the initial period as a whole, and/or the lengths of the periods P1-1, P1-2, P2-1, P2-2 and P2-3 may be changed, and embodiments are not limited to the period lengths described in this example implementation.

Setting the voltage Vset1 to be less than the voltage Vset' may result in a weak discharge being generated between the scan electrode Y and the sustain electrode X, and between the scan electrode Y and the address electrode A, while the voltage of the scan electrode Y is increased during cycles P1 of the first waveform. Therefore, generation of a strong discharge between the scan electrode and the sustain electrode X when the voltage of the scan electrode Y is increased to the voltage Vset' may be suppressed during the application of the second waveform.

Through repetition of the above operations, a sufficient amount of priming particles may be formed in the cell. If an insufficient amount of priming particles exist in the cell, a strong discharge may be generated when the voltage of the scan electrode Y is increased to the voltage Vset', even if the voltage Vset' is set to a low voltage.

Figure 5:
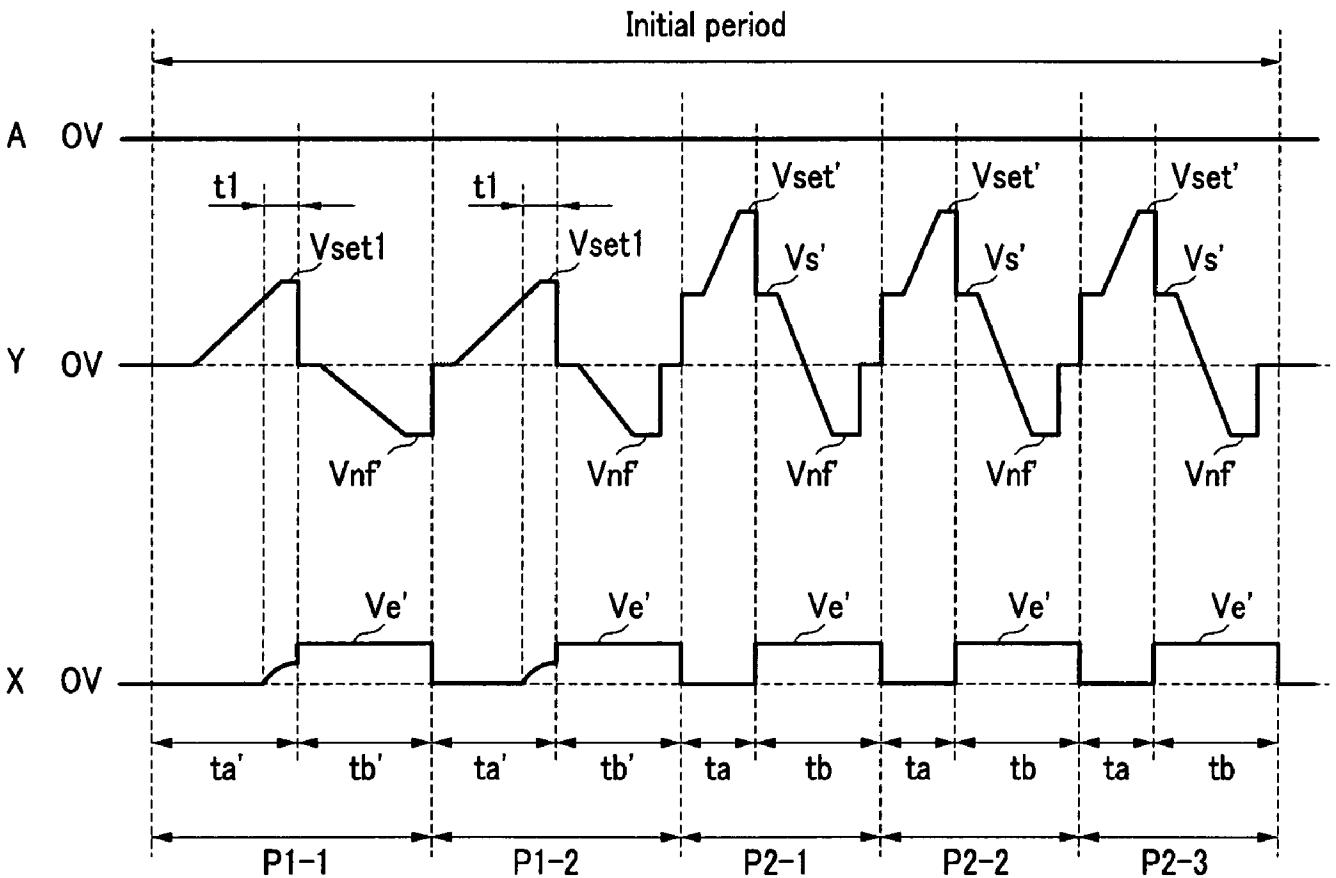
FIG. 5 illustrates an initial driving waveform of the plasma display device according to a second embodiment, which precedes the driving waveform shown in FIG. 2.

FIG. 5 illustrates an initial driving waveform of the plasma display device according to a second embodiment, which precedes the driving waveform shown in FIG. 2.

As shown in FIG. 5, during the initial period after the plasma display device is turned on and before the application of the driving waveforms, e.g., the before the application of the driving waveforms shown in FIG. 2, first and second waveforms of the initial driving waveform according to the second embodiment may be applied to the electrodes of the discharge cell.

The first waveform may be applied for one or more cycles thereof before applying the second waveform. For example, as shown in FIG. 5, the first waveform may be applied for two cycles, as indicated by the periods P1-1 and P1-2. The portions of the second waveform applied to the address electrode A and the scan electrode Y shown in FIG. 5 may be the same as the corresponding portions of the second waveform applied to the address and scan electrodes A and Y in FIG. 4, and may be the same as the corresponding portions of the waveform applied to the address and scan electrodes A and Y in FIG. 3.

As shown in FIG. 5, the sustain electrode X may be placed in a floating state during a predetermined period t1 of the time ta', i.e., while the voltage of the scan electrode Y is gradually increased to the voltage Vset1. When the sustain electrode X is floated during the period t1 while the voltage of the scan electrode Y is gradually increased to the voltage Vset1 voltage, the voltage of the floating sustain electrode X may rise. Accordingly, a voltage difference between the scan electrode Y and the sustain electrode X may be reduced. Thus, a strong discharge, generated between the scan electrode Y and the sustain electrode X when the voltage of the scan electrode Y is increased to the voltage Vset', may be suppressed.

The predetermined period t1 may be a period lasting until the voltage of the scan voltage Y reaches the voltage Vset1, after a discharge is generated between the scan electrode Y and the sustain electrode X, and between the scan electrode Y and the address electrode A.

As described above, the plasma display device may be stably driven after being turned on by using an initial driving waveform according to the example embodiments.

Example embodiments have been disclosed herein, and although specific terms are employed, they are used and are to be interpreted in a generic and descriptive sense only and not for purpose of limitation. For example, although example embodiments describe the voltage of the scan electrode Y as gradually decreasing in a ramp pattern, the voltage of the scan electrode Y may be decreased in a step pattern or a time-varying waveform (e.g., an RC waveform), or it may be changed in accordance with alternation of a pulse and a floating state. Further, although a three-electrode PDP is described as an example, the above-described embodiments may be adapted to PDPs having different structures. Further, embodiments may be implemented in software, e.g., by an article of manufacture having encoded thereon machine-accessible instructions. Accordingly, it will be understood by those of ordinary skill in the art that various changes in form and details may be made without departing from the spirit and scope of the present invention as set forth in the following claims.

What is claimed is:

1. A method of driving a plasma display device having a first electrode and a second electrode adjacent to one another in a discharge cell, the method comprising:

applying a first waveform at least once to the first electrode, the first waveform including a gradual increase from a first voltage to a second voltage followed by a gradual decrease from a third voltage to a fourth voltage;

applying a second waveform at least once to the first electrode after the first waveform is applied to the first electrode, the second waveform including a gradual increase from a fifth voltage to a sixth voltage followed by a gradual decrease from a seventh voltage to an eighth voltage; and applying a reset waveform to the first and second electrodes during a reset period of a subfield for performing the display operation, the reset period being immediately after the application of the first and second waveforms, and the reset waveform initializing the discharge cell before an address period thereof, wherein:

the fifth voltage is greater than the first voltage, the sixth voltage is greater than the second voltage, during the gradual increases in the voltage of the first electrode, the second electrode is maintained at a reference voltage, during the gradual decreases in the voltage of the first electrode, the second electrode is maintained at a voltage greater than the reference voltage, the first and second waveforms are applied to the first electrode after turning on the plasma display device and before a display operation is performed, applying the reset waveform includes applying the second waveform to the first electrode, during gradual increases in the voltage of the first electrode in the reset waveform, the second electrode is maintained at the reference voltage, and during gradual decreases in the voltage of the first electrode in the reset waveform, the second electrode is maintained at a voltage greater than the reference voltage.

2. The method as claimed in claim 1, wherein a period of the first waveform during which the voltage of the first electrode is gradually increased from the first voltage to the second voltage is longer than a period of the second waveform during which the voltage of the first electrode is gradually increased from the fifth voltage to the sixth voltage.

3. The method as claimed in claim 1, wherein a rate of increase in the voltage of the first waveform from the first voltage to the second voltage is less than a rate of increase in the voltage of the second waveform from the fifth voltage to the sixth voltage.

4. The method as claimed in claim 1, wherein, during the gradual increase in the voltage of the first electrode to the second voltage, the second electrode is allowed to float after being maintained at the reference voltage and before the voltage of the first electrode reaches the second voltage.

5. The method as claimed in claim 1, wherein a voltage difference between the first and second electrodes at the end of the gradual increase in the voltage of the first electrode during application of the first waveform is less than a voltage difference between the first and second electrodes at the end of the gradual increase in the voltage of the first electrode during application of the second waveform.

6. A plasma display device, comprising:

a plasma display panel having a plurality of discharge cells corresponding to a plurality of first electrodes and a plurality of second electrodes, the plurality of first and second electrodes performing a display operation;

a controller configured to drive one frame by dividing the frame into a plurality of subfields including at least one reset period; and a driving circuit configured to apply a driving voltage to the plurality of first electrodes and the plurality of second electrodes, the driving circuit being configured to:

apply a first waveform at least once to the first electrode, the first waveform including a gradual increase from a first voltage to a second voltage followed by a gradual decrease from a third voltage to a fourth voltage; and apply a second waveform at least once to the first electrode after the first waveform is applied to the first electrode, the second waveform including a gradual increase from a fifth voltage to a sixth voltage followed by a gradual decrease from a seventh voltage to an eighth voltage, wherein:

the fifth voltage is greater than the first voltage, the sixth voltage is greater than the second voltage, during the gradual increases in the voltage of the first electrode, the second electrode is maintained at a reference voltage, during the gradual decreases in the voltage of the first electrode, the second electrode is maintained at a voltage greater than the reference voltage, the first and second waveforms are applied to the first electrode after turning on the plasma display device and before a display operation is performed, the driving circuit applies a reset waveform to the first and second electrodes during a reset period of a subfield for performing the display operation, the reset period being immediately after the application of the first and second waveforms, the reset waveform initializing the discharge cell before an address period thereof, applying the reset waveform includes applying the second waveform to the first electrode, during gradual increases in the voltage of the first electrode in the reset waveform, the driving circuit maintains the second electrode at the reference voltage, and during gradual decreases in the voltage of the first electrode in the reset waveform, the driving circuit maintains the second electrode at a voltage greater than the reference voltage.

7. The plasma display device as claimed in claim 6, wherein the driving circuit sets a period of the first waveform during which the voltage of the first electrode is gradually increased from the first voltage to the second voltage to be longer than a period of the second waveform during which the voltage of the first electrode is gradually increased from the fifth voltage to the sixth voltage.

8. The plasma display device as claimed in claim 6, wherein the driving circuit sets a rate of increase in the voltage of the first waveform from the first voltage to the second voltage to be less than a rate of increase in the voltage of the second waveform from the fifth voltage to the sixth voltage.

9. The plasma display device as claimed in claim 6, wherein, during the gradual increase in the voltage of the first electrode to the second voltage, the driving circuit allows the second electrode to float after maintaining the second electrode at the reference voltage and before the voltage of the first electrode reaches the second voltage.

10. The plasma display device as claimed in claim 6, wherein a voltage difference between the first and second electrodes at the end of the gradual increase in the voltage of the first electrode during application of the first waveform is less than a voltage difference between the first and second electrodes at the end of the gradual increase in the voltage of the first electrode during application of the second waveform.

11. A method of driving a plasma display device having a first electrode and a second electrode adjacent to one another in a discharge cell, the method comprising:

gradually increasing an initialization voltage difference from a first amount to a second amount, the initialization voltage difference being a voltage difference between the second electrodes and the first electrodes;

gradually decreasing the initialization voltage difference from a third amount to a fourth amount;

gradually increasing the initialization voltage difference from a fifth amount to a sixth amount;

gradually decreasing the initialization voltage difference from a seventh amount to an eighth amount; and applying a reset waveform to the first and second electrodes during a reset period of a subfield for performing the display operation, the reset period being immediately after the increase of the initialization voltage difference to the sixth amount and the decrease of the initialization voltage difference to the eighth amount, wherein:

the fifth amount is greater than the first amount, the sixth amount is greater than the second amount, the first through eighth amounts of the initialization voltage difference occur sequentially after turning on the plasma display and before a display operation is performed, the initialization voltage difference is increased to the sixth amount after repeating the increase of the initialization voltage difference to the second amount and the decrease the initialization voltage difference to the fourth amount at least one time, and after the initialization voltage difference is decreased to the eighth amount, the increase of the initialization voltage difference to the sixth amount and the decrease of the initialization voltage difference to the eighth amount is repeated at least one time.

12. The method as claimed in claim 11, wherein a period during which the initialization voltage difference is gradually increased from the first amount to the second amount is longer than a period during which the initialization voltage difference is gradually increased from the fifth amount to the sixth amount.

13. The method as claimed in claim 12, wherein:

gradually increasing the initialization voltage difference from the first amount to the second amount includes increasing the voltage of the first electrode from a first voltage to a second voltage while maintaining the voltage of the second electrode at a reference voltage, and gradually increasing the initialization voltage difference from the fifth amount to the sixth amount includes increasing the voltage of the first electrode from a fifth voltage to a sixth voltage while maintaining the voltage of the second electrode at the reference voltage, the fifth voltage is greater than the first voltage, and the sixth voltage is greater than the second voltage.

14. The method as claimed in claim 13, wherein, during the gradual increase in the initialization voltage difference to the second amount, the second electrode is allowed to float after being maintained at the reference voltage and before the initialization voltage difference reaches the second amount.

* * * * *